US011656016B2

(12) United States Patent
Ito et al.

(10) Patent No.: US 11,656,016 B2
(45) Date of Patent: May 23, 2023

(54) COOLING SYSTEM THAT COMPRISES MULTIPLE COOLING APPARATUS AND REDUCES POWER CONSUMPTION

(71) Applicants: CKD CORPORATION, Aichi (JP); EBARA CORPORATION, Tokyo (JP); EBARA REFRIGERATION EQUIPMENT & SYSTEMS CO., LTD., Tokyo (JP)

(72) Inventors: Akihiro Ito, Aichi (JP); Norio Kokubo, Aichi (JP); Masayuki Kouketsu, Aichi (JP); Isahiro Hasegawa, Aichi (JP); Toshiharu Nakazawa, Tokyo (JP); Keisuke Takanashi, Tokyo (JP); Yukihiro Fukusumi, Tokyo (JP)

(73) Assignee: EBARA REFRIGERATION EQUIPMENT & SYSTEMS CO., LTD., Tokyo (JP)

( * ) Notice: Subject to any disclaimer, the term of this patent is extended or adjusted under 35 U.S.C. 154(b) by 249 days.

(21) Appl. No.: 17/100,191

(22) Filed: Nov. 20, 2020

(65) Prior Publication Data

US 2021/0148621 A1 May 20, 2021

(30) Foreign Application Priority Data

Nov. 20, 2019 (JP) ..... JP2019-209956

(51) Int. Cl.
*F25B 49/02* (2006.01)
*F25B 31/02* (2006.01)
(Continued)

(52) U.S. Cl.
CPC ..... *F25B 49/022* (2013.01); *F25B 31/02* (2013.01); *F25B 41/20* (2021.01); *F25B 7/00* (2013.01);
(Continued)

(58) Field of Classification Search
CPC ..... F25B 5/02; F25B 5/70; F25B 2400/0401; F25B 2700/151; F25B 2700/21171
See application file for complete search history.

(56) References Cited

U.S. PATENT DOCUMENTS 4,271,679 A 6/1981 Schäfer
5,335,508 A * 8/1994 Tippmann ..... F25B 7/00 62/305
(Continued)

FOREIGN PATENT DOCUMENTS

JP 2716248 B2 2/1998
JP H11183005 A 7/1999
(Continued)

OTHER PUBLICATIONS

Office Action issued in related U.S. Appl. No. 17/093,002 dated Nov. 14, 2022 (17 pages).
(Continued)

*Primary Examiner* — Jerry-Daryl Fletcher
*Assistant Examiner* — Daniel C Comings
(74) *Attorney, Agent, or Firm* — Osha Bergman Watanabe & Burton LLP

(57) ABSTRACT

A cooling system includes: a first cooling apparatus electrically driven to supply a first heat transfer medium cooled to a first set temperature or lower; a plurality of second cooling apparatuses each of which includes a heat exchanger that exchanges heat between the first heat transfer medium supplied from the first cooling apparatus and a second heat transfer medium, and is electrically driven to supply a third heat transfer medium cooled to a second set temperature or lower, the second set temperature being changed individually with lapse of time; and a processor that obtains second
(Continued)

set temperatures of the second cooling apparatuses and sets the first set temperature based on the obtained second set temperatures.

9 Claims, 3 Drawing Sheets

(51) Int. Cl.
*F25B 41/20* (2021.01)
*F25B 7/00* (2006.01)

(52) U.S. Cl.
CPC ..... *F25B 2400/0401* (2013.01); *F25B 2600/0251* (2013.01); *F25B 2600/2519* (2013.01); *F25B 2700/151* (2013.01); *F25B 2700/21* (2013.01)

(56) References Cited

U.S. PATENT DOCUMENTS 6,148,626 A 11/2000 Iwamoto
7,988,062 B2 8/2011 Nonaka et al.
10,580,577 B2 3/2020 Akiyoshi
2005/0252222 A1* 11/2005 Jessen ..... F25B 5/02 62/175
2009/0118872 A1 5/2009 Nonaka et al.
2010/0206519 A1 8/2010 Cho et al.
2018/0156474 A1 6/2018 Göransson
2018/0374639 A1 12/2018 Akiyoshi
2021/0140719 A1 5/2021 Ito et al.
2021/0310688 A1* 10/2021 Kato ..... F24D 19/1039

FOREIGN PATENT DOCUMENTS

JP 2000339038 A 12/2000
JP 2001134324 A 5/2001
JP 4956672 B2 6/2012
JP 5032269 B2 9/2012
JP 5445766 B2 3/2014
JP 2015183993 A 10/2015
JP 2019009359 A 1/2019

OTHER PUBLICATIONS

Office Action issued in corresponding Taiwanese Patent Application No. 109137322 dated Nov. 3, 2022 (14 pages).

* cited by examiner

COOLING SYSTEM THAT COMPRISES MULTIPLE COOLING APPARATUS AND REDUCES POWER CONSUMPTION

CROSS REFERENCE TO RELATED APPLICATION

The present application is based on Japanese Patent Application No. 2019-209956 filed on Nov. 20, 2019, the entire content of which is incorporated herein by reference.

BACKGROUND

Technical Field

The present disclosure relates to a cooling system which includes a first cooling apparatus and a plurality of second cooling apparatuses to which a heat transfer medium is supplied from the first cooling apparatus.

Description of the Related Art

Conventionally, there has been known a cooling system which includes a plurality of cooling apparatuses for cooling a plurality of heat generating elements, respectively, piping connected to the plurality of cooling apparatuses, and a pump connected to the piping and in which a refrigerant is supplied through the piping to cooling pipes extending through the interiors of the plurality of cooling apparatuses (see Japanese Patent Application Laid-Open (kokai) No. 2015-183993). In this cooling system, the flow rate of the refrigerant supplied to each cooling apparatus is optimized so as to prevent excessive operation of the pump, thereby reducing the power consumption thereof.

Although the cooling system disclosed in Japanese Patent Application Laid-Open No. 2015-183993 reduces the power consumption of the pump, the cooling system is not designed in consideration of power consumption of an apparatus for cooling the refrigerant, and therefor has room for improvement, in terms of reducing the power consumption of the entire cooling system.

SUMMARY

One or more embodiments of the present invention provide a cooling system which includes a first cooling apparatus and a plurality of second cooling apparatuses to which a heat transfer medium is supplied from the first cooling apparatus and which can reduce the power consumption of the entire cooling system.

One or more embodiments provide a cooling system which includes a first cooling apparatus, a plurality of second cooling apparatuses, and a setting section (i.e., processor). The first cooling apparatus is electrically driven so as to supply a first heat transfer medium cooled to a first set temperature or lower. Each second cooling apparatus includes a heat exchange section for heat exchange between the first heat transfer medium supplied from the first cooling apparatus and a second heat transfer medium. Each second cooling apparatus is electrically driven so as to supply a third heat transfer medium cooled to a second set temperature or lower, the second set temperature being changed individually with lapse of time. The setting section obtains the second set temperatures of the plurality of second cooling apparatuses and variably sets the first set temperature on the basis of the plurality of obtained second set temperatures.

According to the above-described configuration, the first cooling apparatus is electrically driven so as to supply the first heat transfer medium cooled to the first set temperature or lower. Therefore, the first cooling apparatus consumes electrical power when cooling the first heat transfer medium to the first set temperature or lower.

Each second cooling apparatus is electrically driven so as to supply the third heat transfer medium cooled to the second set temperature or lower, the second set temperature being changed individually with lapse of time. Therefore, each second cooling apparatus consumes electrical power when cooling the third heat transfer medium to the second set temperature or lower. Meanwhile, each second cooling apparatus includes a heat exchange section for heat exchange between the first heat transfer medium supplied from the first cooling apparatus and the second heat transfer medium. Therefore, when cooling the third heat transfer medium, each second cooling apparatus can use thermal energy supplied from the first heat transfer medium to the second heat transfer medium through the heat exchange section.

The lower the first set temperature, the larger the power consumption of the first cooling apparatus. Meanwhile, the lower the first set temperature, the smaller the power consumptions of the plurality of second cooling apparatuses. The sum of the power consumption of the first cooling apparatus and the power consumptions of the plurality of second cooling apparatuses changes depending on the relation between the first set temperature and the individual second set temperatures of the plurality of second cooling apparatuses at each point in time. In view of this, the setting section obtains the second set temperatures of the plurality of second cooling apparatuses and variably sets the first set temperature on the basis of the obtained second set temperatures. Accordingly, the first set temperature can be changed appropriately in accordance with the plurality of second set temperatures at each point in time, whereby the power consumption of the entire cooling system can be reduced.

The greater the amounts by which the second set temperatures are lower than the first set temperature, the greater the power consumptions of the second cooling apparatuses. In addition, when the differences between the second set temperatures and the first set temperature increase, the power consumptions increase in a quadratic curve.

In view of this, in a second means, the setting section variably sets the first set temperature to the average of the plurality of obtained second set temperatures. By virtue of such a configuration, it is possible to prevent the differences between the second set temperatures and the first set temperature from becoming extremely large, and none of the power consumptions of the second cooling apparatuses become extremely large. Accordingly, the power consumption of the entire cooling system can be reduced.

In a third means, each of the second cooling apparatuses includes a compression section which is electrically driven so as to compress the second heat transfer medium in gas state, a bypass flow passage through which the second heat transfer medium flows while bypassing the compression section, and an on-off valve for opening and closing the bypass flow passage. The setting section variably sets the first set temperature to a stop temperature which is the first set temperature which allows a target second cooling apparatus, which is a second cooling apparatus whose second set temperature is the highest among the plurality of obtained second set temperatures, to supply the third heat transfer medium cooled to the highest second set temperature or lower in a state in which the compression section is stopped and the on-off valve is opened, and the setting section stops the compression section and opens the on-off valve in the target second cooling apparatus.

According to the above-described configuration, each second cooling apparatus includes a compression section which is electrically driven so as to compress the second heat transfer medium in gas state, a bypass flow passage through which the second heat transfer medium flows while bypassing the compression section, and an on-off valve for opening and closing the bypass flow passage. Therefore, when the first set temperature is sufficiently lower than the second set temperature of a second cooling apparatus, the second cooling apparatus can supply the third heat transfer medium cooled to the second set temperature or lower by means of so-called free cooling by stopping the compression section and opening the on-off valve.

In view of this, the setting section variably sets the first set temperature to a stop temperature which is the first set temperature which allows a target second cooling apparatus, which is a second cooling apparatus whose second set temperature is the highest among the plurality of obtained second set temperatures, to supply the third heat transfer medium cooled to the highest second set temperature or lower in a state in which the compression section is stopped and the on-off valve is opened. Subsequently, the setting section stops the compression section and opens the on-off valve in the target second cooling apparatus. Therefore, the target second cooling apparatus can supply the third heat transfer medium cooled to the corresponding second set temperature or lower by means of free cooling, whereby the power consumption of the target second cooling apparatus can be reduced greatly. For example, the stop temperature is a temperature obtained by subtracting a necessary temperature difference required for free cooling from the highest second set temperature.

As described above, the lower the first set temperature, the larger the power consumption of the first cooling apparatus. Therefore, in the case where the highest second set temperature is lower than a predetermined temperature, if the first set temperature is set to the stop temperature and the target second cooling apparatus is caused to perform free cooling, there arises a possibility that the power consumption of the first cooling apparatus becomes excessively large, and the power consumption of the entire cooling system cannot be reduced.

In order to avoid such a possibility, in a fourth means, on the condition that the highest second set temperature among the plurality of obtained second set temperatures is higher than a predetermined temperature, the setting section sets the first set temperature to the stop temperature, and stops the compression section and opens the on-off valve in the target second cooling apparatus. Namely, in the case where the highest second set temperature is higher than the predetermined temperature, the target second cooling apparatus performs free cooling, and, in the case where the highest second set temperature is lower than the predetermined temperature, the target second cooling apparatus does not perform free cooling. Accordingly, the power consumption of the entire cooling system can be reduced.

In a fifth means, each of the second cooling apparatuses includes a compression section which is electrically driven so as to compress the second heat transfer medium in gas state, a bypass flow passage through which the second heat transfer medium flows while bypassing the compression section, and an on-off valve for opening and closing the bypass flow passage. The setting section variably sets the first set temperature to a stop temperature which is the first set temperature which allows target second cooling apparatuses, which are second cooling apparatuses whose second set temperature is found in the largest number among the plurality of obtained second set temperatures, to supply the third heat transfer medium cooled to the largest-number second set temperature or lower in a state in which the compression section is stopped and the on-off valve is opened, and the setting section stops the compression section and opens the on-off valve in each of the target second cooling apparatuses.

According the above-described configuration, as in the third means, when the first set temperature is sufficiently lower than the second set temperature of a second cooling apparatus, the second cooling apparatus can perform free cooling. In view of this, the setting section variably sets the first set temperature to a stop temperature which is the first set temperature which allows target second cooling apparatuses, which are second cooling apparatuses whose second set temperature is found in the largest number among the plurality of obtained second set temperatures, to supply the third heat transfer medium cooled to the largest-number second set temperature or lower in a state in which the compression section is stopped and the on-off valve is opened. Subsequently, the setting section stops the compression section and opens the on-off valve in each of the target second cooling apparatuses. Therefore, the target second cooling apparatuses can supply the third heat transfer medium cooled to the corresponding second set temperature or lower by means of free cooling, whereby the power consumptions of the target second cooling apparatuses can be reduced greatly. For example, the stop temperature is a temperature obtained by subtracting a necessary temperature difference required for free cooling from the largest-number second set temperature.

As described above, the lower the first set temperature, the larger the power consumption of the first cooling apparatus. Therefore, in the case where the largest-number second set temperature is lower than a predetermined temperature, if the first set temperature is set to the stop temperature and the target second cooling apparatuses are caused to perform free cooling, there arises a possibility that the power consumption of the first cooling apparatus becomes excessively large, and the power consumption of the entire cooling system cannot be reduced.

In order to avoid such a possibility, in a sixth means, on the condition that the largest-number second set temperature among the plurality of obtained second set temperatures is higher than a predetermined temperature, the setting section sets the first set temperature to the stop temperature, and stops the compression section and opens the on-off valve in each of the target second cooling apparatuses. Namely, in the case where the largest-number second set temperature is higher than the predetermined temperature, the target second cooling apparatuses perform free cooling, and, in the case where the largest-number second set temperature is lower than the predetermined temperature, the target second cooling apparatuses do not perform free cooling. Accordingly, the power consumption of the entire cooling system can be reduced.

The power consumption of the cooling system changes depending on the combination of the first set temperature and the plurality of second set temperatures. The relation among the first set temperature, the plurality of second set temperatures, and the measured value of the power consumption of the cooling system can be obtained beforehand through, for example, an experiment.

In view of this, in a seventh means, the setting section variably sets the first set temperature, on the basis of a previously obtained relation among the first set temperature, the plurality of second set temperatures, and a measured value of power consumption of the cooling system, and the plurality of obtained second set temperatures, such that the power consumption of the cooling system becomes the minimum. By virtue of such a configuration, since the relation among the first set temperature, the plurality of second set temperatures, and the measured value of the power consumption of the cooling system is obtained beforehand, it is possible to reduce the power consumption of the entire cooling system while reducing the processing load of the setting section.

The setting section may be configured to learn a predetermined relation among the first set temperature, the plurality of second set temperatures, and the measured value of the power consumption of the cooling system through operation of the cooling system.

In view of this, in an eighth means, the setting section successively obtains the first set temperature, the plurality of second set temperatures, and a measured value of power consumption of the cooling system; learns a predetermined relation among the first set temperature, the plurality of second set temperatures, and the measured value of the power consumption of the cooling system; and variably sets the first set temperature on the basis of the learned predetermined relation and the plurality of obtained second set temperatures such that the power consumption of the cooling system becomes the minimum. By virtue of such a configuration, the setting section can learn the predetermined relation through operation of the cooling system. Therefore, as the learning progresses, the accuracy of the predetermined relation increases, whereby the power consumption of the entire cooling system can be reduced further.

The power consumption of the first cooling apparatus changes in accordance with the first set temperature. The relation between the first set temperature and the measured value of the power consumption of the first cooling apparatus can be obtained beforehand through, for example, an experiment. Also, the power consumptions of the second cooling apparatuses change depending on the combination of the first set temperature and the second set temperatures. The relation among the first set temperature, the plurality of second set temperatures, and the measured values of the power consumptions of the second cooling apparatuses can be obtained beforehand through, for example, an experiment.

In view of this, in a ninth means, the setting section variably sets the first set temperature, on the basis of a previously obtained first relation between the first set temperature and a measured value of the power consumption of the first cooling apparatus, a previously obtained second relation among the first set temperature, the second set temperatures, and measured values of power consumptions of the second cooling apparatuses, and the plurality of obtained second set temperatures, such that the sum of the power consumption of the first cooling apparatus and the power consumptions of the plurality of second cooling apparatuses becomes the minimum. By virtue of such a configuration, the power consumption of the first cooling apparatus and the power consumptions of the second cooling apparatuses can be calculated more accurately, whereby the power consumption of the entire cooling system can be reduced further.

The setting section may be configured to learn the first relation between the first set temperature and the measured value of the power consumption of the first cooling apparatus through operation of the cooling system. Also, the setting section may be configured to learn the second relation among the first set temperature, the second set temperatures, and the measured values of the power consumptions of the second cooling apparatuses through operation of the cooling system.

In view of this, in a tenth means, the setting section successively obtains the first set temperature and a measured value of power consumption of the first cooling apparatus; learns a first relation between the first set temperature and the measured value of the power consumption of the first cooling apparatus; successively obtains the first set temperature, the second set temperatures, and measured values of power consumptions of the second cooling apparatuses; learns a second relation among the first set temperature, the second set temperatures, and the measured values of the power consumptions of the second cooling apparatuses; and variably sets the first set temperature on the basis of the learned first and second relations and the plurality of obtained second set temperatures such that the power consumption of the cooling system becomes the minimum. By virtue of such a configuration, the setting section can learn the first and second relations through operation of the cooling system. Therefore, as the learning progresses, the accuracies of the first and second relations increase, whereby the power consumption of the entire cooling system can be reduced further.

In an eleventh means, the first cooling apparatus includes a first compression section which is electrically driven so as to compress a fourth heat transfer medium in gas state, a first heat exchange section for heat exchange between the fourth heat transfer medium and a fifth heat transfer medium cooled by atmospheric air, a first bypass flow passage through which the fourth heat transfer medium flows while bypassing the first compression section, and a first on-off valve for opening and closing the first bypass flow passage. In the case where the first cooling apparatus can supply the first heat transfer medium cooled to the first set temperature or lower in a state in which the first compression section is stopped and the first on-off valve is opened, the setting section stops the first compression section and opens the first on-off valve.

According to the above-described configuration, the first cooling apparatus includes a first compression section which is electrically driven so as to compress the fourth heat transfer medium in gas state, a first heat exchange section for heat exchange between the fourth heat transfer medium and the fifth heat transfer medium cooled by atmospheric air, a first bypass flow passage through which the fourth heat transfer medium flows while bypassing the first compression section, and a first on-off valve for opening and closing the first bypass flow passage. Therefore, when cooling the first heat transfer medium, the first cooling apparatus can use thermal energy supplied to the fourth heat transfer medium, through the first heat exchange section, from the fifth heat transfer medium cooled by atmospheric air. Accordingly, when the atmospheric temperature is sufficiently lower than the first set temperature, the first cooling apparatus can supply the first heat transfer medium cooled to the first set temperature or lower by means of free cooling by stopping the first compression section and opening the first on-off valve.

In view of this, in the case where the first cooling apparatus can supply the first heat transfer medium cooled to the first set temperature or lower in a state in which the first compression section is stopped and the first on-off valve is opened, the setting section stops the first compression section and opens the first on-off valve. Therefore, the first cooling apparatus can supply the first heat transfer medium cooled to the first set temperature or lower by means of free cooling, whereby the power consumption of the first cooling apparatus can be reduced greatly. For example, the first cooling apparatus performs free cooling in the case where the atmospheric temperature is lower than a temperature obtained by subtracting the necessary temperature difference required for free cooling from the first set temperature.

BRIEF DESCRIPTION OF THE DRAWINGS

The above and other features and advantages of the present disclosure will be apparent from the following description made with reference to the accompanying drawings.

DETAILED DESCRIPTION

First Embodiment

A first embodiment will now be described with reference to the drawings. The first embodiment is embodied as a cooling system including a plurality of chillers which supply heat transfer mediums of different set temperatures to a plurality of control targets, respectively.

Figure 1:
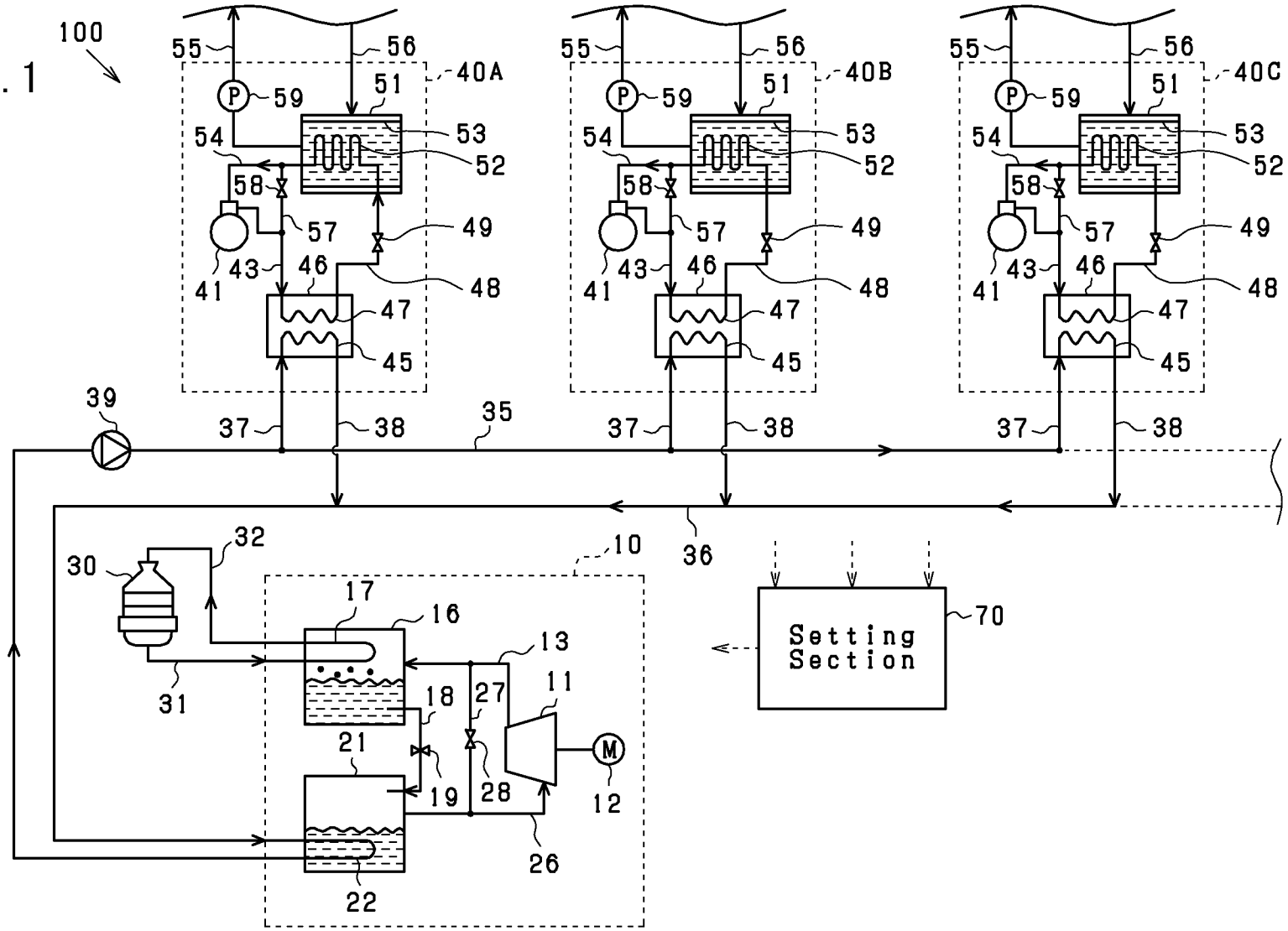
FIG. 1 is a schematic diagram of a cooling system according to a first embodiment.

As shown in FIG. 1, a cooling system 100 includes a high-capacity refrigerator 10, chillers 40A to 40C, a setting section 70, etc.

The high-capacity refrigerator 10 (first cooling apparatus) includes a compressor 11, a condenser 16, an expansion section 19, an evaporator 21, a bypass flow passage 27, an on-off valve 28, etc.

The compressor 11 (first compression section) is driven by a motor 12 and compresses a fourth heat transfer medium in gas state. The fourth heat transfer medium is, for example, a hydrofluorocarbon (HFC)-based refrigerant or a hydrofluoroolefin (HFO)-based refrigerant. The motor 12 is driven by electric power supplied thereto. Namely, the compressor 11 is electrically driven so as to compress the fourth heat transfer medium in gas state. The compressor 11 and the condenser 16 are connected to each other by a flow passage 13.

The condenser 16 (first heat exchange section) condenses the gas-sate fourth heat transfer medium compressed by the compressor 11. Specifically, the condenser 16 has a flow passage 17 with which the gas-state fourth heat transfer medium is brought into contact. One end (first end) of the flow passage 17 and the outlet port of a cooling tower 30 are connected to each other by a flow passage 31. The other end (second end) of the flow passage 17 and the inlet port of the cooling tower 30 are connected to each other by a flow passage 32. The cooling tower 30 cools a fifth heat transfer medium flowing thereinto through the flow passage 32 by using the atmospheric air and discharges the cooled fifth heat transfer medium through the flow passage 31. The fifth heat transfer medium is, for example, water. Namely, in the condenser 16, heat exchange is performed between the fourth heat transfer medium and the fifth heat transfer medium cooled by the atmospheric air.

The fourth heat transfer medium condensed by the condenser 16 is suppled to a flow passage 18. The expansion section 19 is provided in the flow passage 18. The expansion section 19 is an expansion valve or a capillary which expands the fourth heat transfer medium in liquid state, thereby atomizing the fourth heat transfer medium. The fourth heat transfer medium atomized by the expansion section 19 is supplied to the evaporator 21 through the flow passage 18.

The evaporator 21 includes a flow passage 22, etc. In the evaporator 21, the atomized fourth heat transfer medium evaporates. A common flow passage 35 is connected to one end (first end) of the flow passage 22, and a common flow passage 36 is connected to the other end (second end) of the flow passage 22. A first heat transfer medium in liquid state flows through the flow passage 22 and the common flow passages 35 and 36. The first heat transfer medium is, for example, water. By virtue of the configuration described above, the first heat transfer medium flowing through the flow passage 22 is cooled. The fourth heat transfer medium evaporated in the evaporator 21 is supplied to the compressor 11 through a flow passage 26.

The bypass flow passage 27 (first bypass flow passage) causes the fourth heat transfer medium to flow from the flow passage 26 to the flow passage 13 while bypassing the compressor 11. An on-off valve 28 (first on-off valve) for opening and closing the bypass flow passage 27 is provided in the bypass flow passage 27.

The high-capacity refrigerator 10 cools the first heat transfer medium flowing through the flow passage 22 to a first set temperature Tw and supplies the cooled first heat transfer medium to the common flow passage 35. A pump 39 is provided in the common flow passage 35. The pump 39 causes the first heat transfer medium to circulate through the flow passage 22 and the common flow passages 35 and 36. The operating state of the high-capacity refrigerator 10 is controlled by the setting section 70.

The setting section 70 is a microcomputer including a CPU, a ROM, a RAM, an input/output interface, etc. The setting section 70 controls the drive states of the compressor 11 and the pump 23 such that the first heat transfer medium cooled to the first set temperature Tw is supplied to the common flow passage 35.

Also, in the case where the high-capacity refrigerator 10 can supply the first heat transfer medium of the first set temperature Tw or lower in a state in which the compressor 11 is stopped and the on-off valve 28 is opened, the setting section 70 stops the compressor 11 and opens the on-off valve 28 (free cooling). For example, since the atmospheric temperature is low in winter, the temperature of the fifth heat transfer medium supplied from the cooling tower 30 to the condenser 16 becomes low. Accordingly, even in a state in which the compressor 11 is stopped, the first heat transfer medium flowing through the flow passage 22 of the evaporator 21 can be cooled, and the high-capacity refrigerator 10 can supply the first heat transfer medium cooled to the first set temperature Tw or lower. Notably, when the temperature of the fifth heat transfer medium supplied from the cooling tower 30 to the condenser 16 is lower than the first set temperature Tw by about 10° C. (necessary temperature difference) or more, the high-capacity refrigerator 10 can perform free cooling.

The chillers 40A to 40C (second cooling apparatuses) have the same configuration. Here, the chiller 40A will be described.

The chiller 40A includes a compressor 41, a condenser 46, an expansion section 49, an evaporator 51, a bypass flow passage 57, an on-off valve 58, etc.

The compressor 41 (compression section) is electrically driven so as to compress a second heat transfer medium in gas state. The second heat transfer medium is, for example, a hydrofluorocarbon (HFC)-based refrigerant or a hydrofluoroolefin (HFO)-based refrigerant. The compressor 41 and the condenser 46 are connected to each other by a flow passage 43.

The condenser 46 (heat exchange section) condenses the gas-state second heat transfer medium compressed by the compressor 41. Specifically, the condenser 46 has a flow passage 47 through which the gas-state second heat transfer medium flows. A flow passage 43 is connected to one end (first end) of the flow passage 47, and a flow passage 48 is connected to the other end (second end) of the flow passage 47. The condenser 46 has a flow passage 45 through which the liquid-state first heat transfer medium flows. A branch flow passage 37 is connected to one end (first end) of the flow passage 45, and a branch flow passage 38 is connected to the other end (second end) of the flow passage 45. The branch flow passage 37 is branched from the common flow passage 35. The branch flow passage 38 is branched from the common flow passage 36. In the condenser 46, heat exchange is performed between the first heat transfer medium flowing through the flow passage 45 and the second heat transfer medium flowing through the flow passage 47.

The second heat transfer medium condensed by the condenser 46 is supplied to the flow passage 48. The expansion section 49 is provided in the flow passage 48. The expansion section 49 is an expansion valve or a capillary which expands the second heat transfer medium in liquid state, thereby atomizing the second heat transfer medium. The second heat transfer medium atomized by the expansion section 49 is supplied to the evaporator 51 through the flow passage 48.

The evaporator 51 includes a flow passage 52, a flow-through section 53, etc. The atomized second heat transfer medium flows through the flow passage 52. The flow passage 48 is connected to one end (first end) of the flow passage 52, and a flow passage 54 is connected to the other end (second end) of the flow passage 52. The flow passage 52 and the compressor 41 are connected to each other by the flow passage 54. The flow passage 52 is accommodated in the flow-through section 53. Flow passages 55 and 56 are connected to the flow-through section 53. A third heat transfer medium flows through the flow-through section 53, the flow passage 55, and the flow passage 56. The third heat transfer medium is, for example, a liquid composed of ethylene glycol (60%) and water (40%). A pump 59 is provided in the flow passage 55. The pump 59 causes the third heat transfer medium to circulate through the flow-through section 53 and the flow passages 55 and 56. By virtue of the configuration described above, the second heat transfer medium flowing through the flow passage 52 evaporates, and thus the third heat transfer medium flowing through the flow-through section 53 is cooled. The second heat transfer medium evaporated in the evaporator 51 is supplied to the compressor 41 through the flow passage 54.

The bypass flow passage 57 (bypass flow passage) causes the second heat transfer medium to flow from the flow passage 54 to the flow passage 43 while bypassing the compressor 41. An on-off valve (on-off valve) for opening and closing the bypass flow passage 57 is provided in the bypass flow passage 57.

The chiller 40A cools the third heat transfer medium flowing through the flow-through section 53 to a second set temperature Ta and supplies the cooled third heat transfer medium to the flow passage 55. The operation state of the chiller 40A is controlled by the setting section 70. The setting section 70 controls the drive state of the compressor 41 such that the third heat transfer medium cooled to the second set temperature is supplied to the flow passage 55.

Also, in the case where the chiller 40A can supply the third heat transfer medium of the second set temperature Ta or lower in a state in which the compressor 41 is stopped and the on-off valve 58 is opened, the setting section 70 stops the compressor 41 and opens the on-off valve 58 (free cooling). Notably, when the temperature of the first heat transfer medium supplied from the common flow passage 35 to the condenser 46 is lower than the second set temperature Ta by about 10° C. (necessary temperature difference) or more, the chiller 40A can perform free cooling.

Similarly, the chiller 40B cools the third heat transfer medium flowing through the flow-through section 53 of the chiller 40B to a second set temperature Tb and supplies the cooled third heat transfer medium to the flow passage 55 of the chiller 40B, and the chiller 40C cools the third heat transfer medium flowing through the flow-through section 53 of the chiller 40C to a second set temperature Tc and supplies the cooled third heat transfer medium to the flow passage 55 of the chiller 40C. Also, in the case where the chiller 40B (40C) can supply the third heat transfer medium of the second set temperature Tb (Tc) or lower in a state in which the compressor 41 is stopped and the on-off valve 58 is opened, the setting section 70 stops the compressor 41 and opens the on-off valve 58 (free cooling).

The temperatures of control targets A to C to which the chillers 40A to 40C supply the third heat transfer medium are controlled by control sections A to C (not shown), respectively. The second set temperatures Ta to Tc are set by the control sections A to C, respectively. The second set temperatures Ta to Tc are individually changed by the control sections A to C, respectively, with lapse of time.

Figure 2:
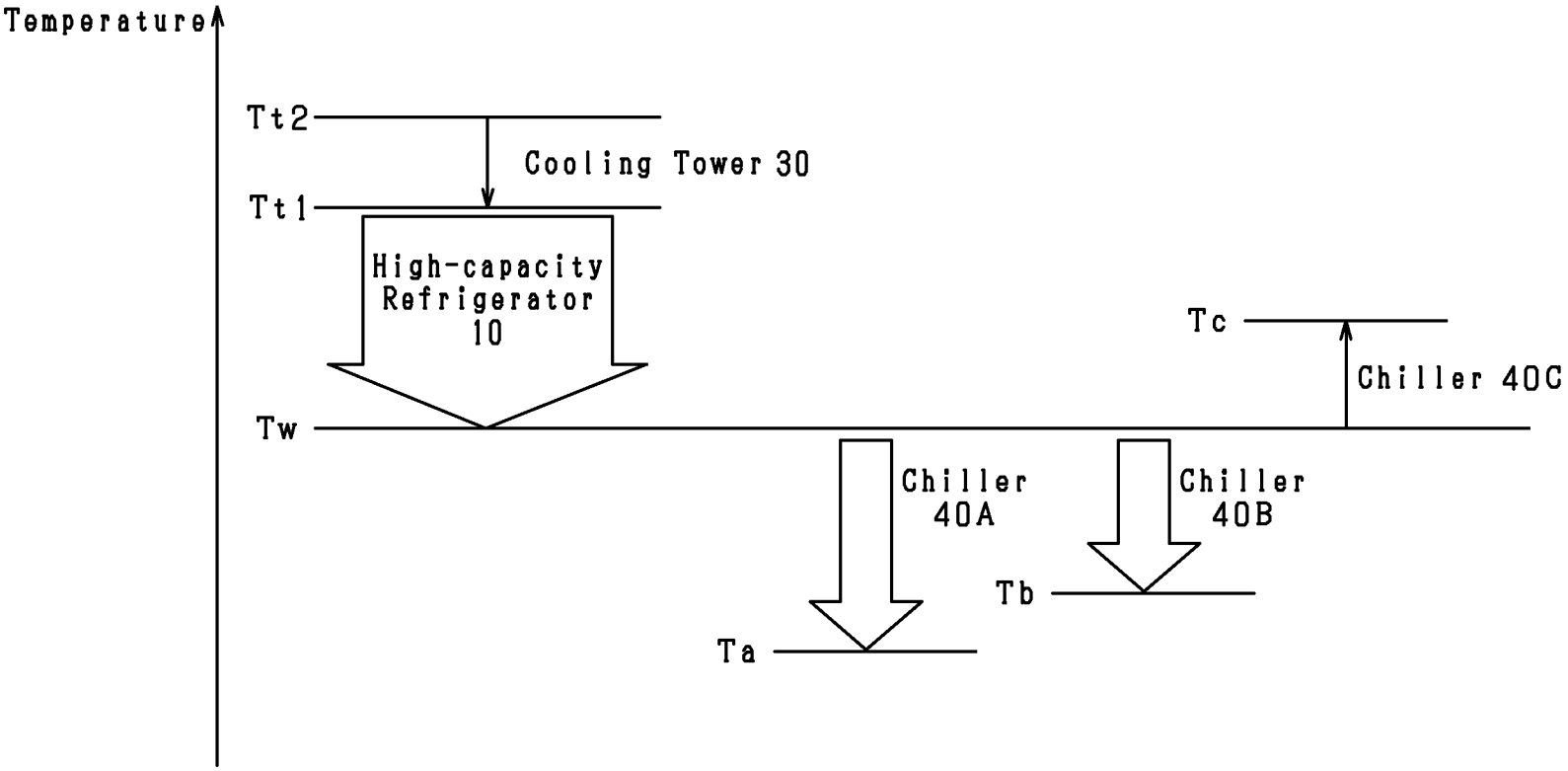
FIG. 2 is a schematic diagram showing the relation among a first set temperature, second set temperatures, and power consumptions.

FIG. 2 is a schematic diagram showing the relation among the first set temperature Tw, the second set temperatures Ta to Tc, and power consumptions. The area of each arrow shows the magnitude of power consumption. Temperature Tt2 is the temperature of the fifth heat transfer medium flowing from the high-capacity refrigerator 10 into the cooling tower 30. Temperature Tt1 is the temperature of the fifth heat transfer medium flowing from the cooling tower 30 into the high-capacity refrigerator 10.

As shown in FIG. 2, the lower the first set temperature Tw, the larger the power consumption Po of the high-capacity refrigerator 10. Meanwhile, the lower the first set temperature Tw, the smaller the power consumptions Pa to Pc of the chillers 40A to 40C. The chiller 40C can perform free cooling and does not consume electrical power (i.e., power consumption Pc=0). The sum of the power consumption Po of the high-capacity refrigerator 10 and the power consumptions Pa to Pc of the chillers 40A to 40C changes depending on the relation between the first set temperature Tw and the individual second set temperatures Ta to Tc of the chillers 40A to 40C at each point in time.

In view of the foregoing, the setting section 70 obtains the second set temperatures Ta to Tc of the chillers 40A to 40C from the above-described control sections A to C, and variably sets the first set temperature Tw on the basis of the obtained second set temperatures Ta to Tc.

Figure 3:
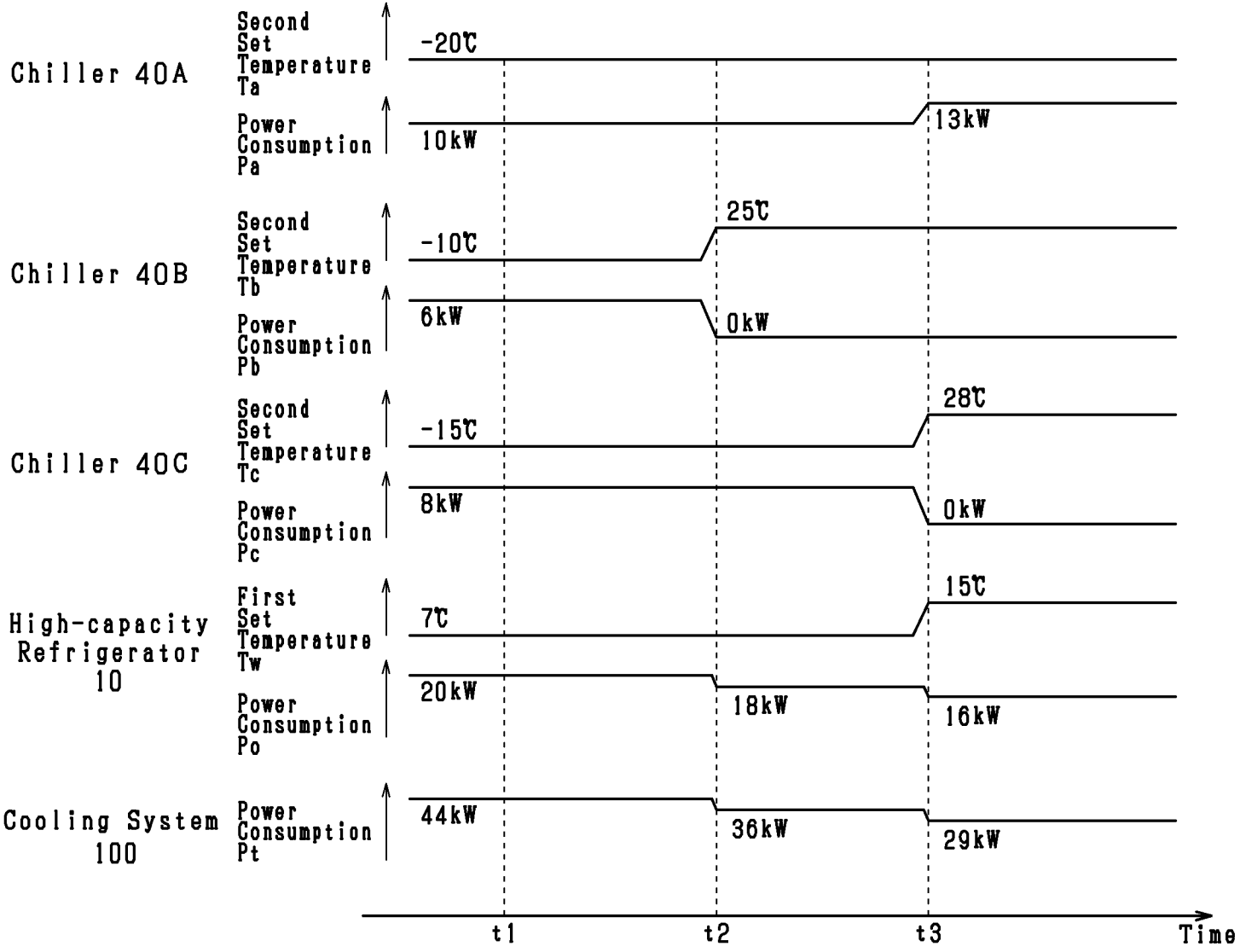
FIG. 3 is a time chart showing the set temperatures and power consumptions of a high-capacity refrigerator and chillers.

FIG. 3 is a time chart showing the set temperatures and power consumptions of the high-capacity refrigerator 10 and the chillers 40A to 40C.

At time t1, the first set temperature Tw of the high-capacity refrigerator 10 is 7° C., and the power consumption Po of the high-capacity refrigerator 10 is 20 kW. The second set temperatures Ta to Tc of the chillers 40A to 40C are −20° C., −10° C., −15° C., respectively, and the power consumptions Pa, Pb, and Pc of the chillers 40A to 40C are 10 kW, 6 kW, and 8 kW, respectively. The power consumption of the entire cooling system 100 is 44 kW, which is the sum of the power consumption Po and the power consumptions Pa to Pc. At that time, the first set temperature Tw of 7° C. is not a first set temperature Tw (stop temperature Tf) which allows the chiller 40B (target chiller, target cooling apparatus), whose second set temperature Tb (=−10° C.) is the highest among the second set temperatures Ta to Tc, to supply the third heat transfer medium of the second set temperature Tb (=−10° C.) or lower in a state in which the compressor 41 is stopped and the on-off valve 58 is opened. The stop temperature Tf is a temperature equal to or lower than a temperature obtained by subtracting the above-described necessary temperature difference (for example, 10° C.) from the highest second set temperature. The stop temperature Tf in this case is about −20° C. or lower.

In the case where the highest second set temperature Tb is lower than a predetermined temperature (for example, 0° C.), if the first set temperature Tw is set to the stop temperature Tf and the chiller 40B performs free cooling, there arises a possibility that the power consumption Po of the high-capacity refrigerator 10 becomes excessively large, and the power consumption Pt of the entire cooling system 100 cannot be reduced. In order to avoid such a possibility, on the condition that the highest one of the second set temperatures Ta to Tc obtained from the control section A to C is higher than the predetermined temperature, the setting section 70 sets the first set temperature Tw to the stop temperature Tf, and stops the compressor 41 and opens the on-off valve 58 in the target chiller (free cooling). At time t1, the first set temperature Tw is not set to the stop temperature Tf and free cooling is not performed. At time t1, the first set temperature Tw is set to 7° C. at which the operation efficiency of the high-capacity refrigerator 10 becomes the maximum. Notably, the first set temperature Tw at which the operation efficiency of the high-capacity refrigerator 10 becomes the maximum changes depending on, for example, the atmospheric temperature and thus the temperature of the fifth heat transfer medium supplied from the cooling tower 30 to the high-capacity refrigerator 10.

At time t2, the second set temperature Tb is changed to 25° C. Therefore, the first set temperature Tw of 7° C. becomes the first set temperature Tw (stop temperature Tf) which allows the chiller 40B (target chiller), whose second set temperature Tb (=25° C.) is the highest among the second set temperatures Ta to Tc, to supply the third heat transfer medium of the second set temperature Tb (=25° C.) or lower in the state in which the compressor 41 is stopped and the on-off valve 58 is opened. Notably, the stop temperature Tf in this case is about 15° C. or lower. The highest second set temperature Tb (=25° C.) among the second set temperatures Ta to Tc is higher than the predetermined temperature (for example, 0° C.). In view of this, the setting section 70 stops the compressor 41 and opens the on-off valve 58 in the chiller 40B, so that the chiller 40B performs free cooling. As a result, the power consumptions Pa to Pc of the chillers 40A to 40C are 10 kW, 0 kW, and 8 kW, respectively, the power consumption Po of the high-capacity refrigerator 10 is 18 kW, and the power consumption Pt of the cooling system 100 is 36 kW.

At time t3, the second set temperature Tc is changed to 28° C. The setting section 70 sets the first set temperature Tw to a first set temperature Tw (=15° C.) (second stop temperature Tf2) which allows the chiller 40B, whose second set temperature Tb (=25° C.) is the second highest among the second set temperatures Ta to Tc, to supply the third heat transfer medium of the second set temperature Tb (=25° C.) or lower in the state in which the compressor 41 is stopped and the on-off valve 58 is opened. Notably, the second stop temperature Tf2 in this case is about 15° C. or lower. The second highest second set temperature Tb (=25° C.) among the second set temperatures Ta to Tc is higher than the predetermined temperature (for example, 0° C.). Moreover, the chiller 40C whose second set temperature Tc (=28° C.) is the highest among the second set temperatures Ta to Tc also satisfies the condition for performing free cooling. Therefore, the setting section 70 stops the compressor 41 and opens the on-off valve 58 in the chiller 40B, so that the chiller 40B performs free cooling, and the setting section 70 stops the compressor 41 and opens the on-off valve 58 in the chiller 40C, so that the chiller 40C performs free cooling. As a result, the power consumptions Pa to Pc of the chillers 40A to 40C are 13 kW, 0 kW, and 0 kW, respectively, the power consumption Po of the high-capacity refrigerator 10 is 16 kW, and the power consumption Pt of the cooling system 100 is 29 kW.

The present embodiment having been described in detail above has the following advantages.

The setting section 70 obtains the second set temperatures Ta to Tc of the chillers 40A to 40C and variably sets the first set temperature Tw on the basis of the obtained second set temperatures Ta to Tc. Accordingly, the first set temperature Tw can be changed appropriately in accordance with the second set temperatures Ta to Tc at each point in time, whereby the power consumption Pt of the entire cooling system 100 can be reduced.

The setting section 70 variably sets the first set temperature Tw to the stop temperature Tf which is a first set temperature Tw which allows a target chiller, which is a chiller whose second set temperature is the highest among the obtained second set temperatures Ta to Tc, to supply the third heat transfer medium of the highest second set temperature or lower in the state in which the compressor 41 is stopped and the on-off valve 58 is opened. Subsequently, the setting section 70 stops the compressor 41 and opens the on-off valve 58 in the target chiller. Therefore, the target chiller can supply the third heat transfer medium cooled to the corresponding second set temperature or lower by means of free cooling, whereby the power consumption of the target chiller can be reduced greatly.

On the condition that the highest second set temperature among the obtained second set temperatures Ta to Tc is higher than a predetermined temperature, the setting section 70 sets the first set temperature Tw to the stop temperature Tf, and stops the compressor 41 and opens the on-off valve 58 in the target chiller. Namely, in the case where the highest second set temperature is higher than the predetermined temperature, the target chiller performs free cooling, and, in the case where the highest second set temperature is lower than the predetermined temperature, the target chiller does not perform free cooling. Accordingly, the power consumption of the entire cooling system 100 can be reduced.

The setting section 70 variably sets the first set temperature Tw to the second stop temperature Tf2 which is a first set temperature Tw which allows a second target chiller, which is a chiller whose second set temperature is the second highest among the obtained second set temperatures Ta to Tc, to supply the third heat transfer medium of the second highest second set temperature or lower in the state in which the compressor 41 is stopped and the on-off valve 58 is opened. Subsequently, the setting section 70 stops the compressor 41 and opens the on-off valve 58 in the second target chiller. Therefore, the second target chiller can supply the third heat transfer medium cooled to the corresponding second set temperature or lower by means of free cooling, whereby the power consumption of the second target chiller can be reduced greatly.

Second Embodiment

A second embodiment will now be described. In the following description, the difference between the second embodiment and the first embodiment will be mainly described. Notably, portions identical with those of the first embodiment are denoted by the same reference numerals, and their description will not be repeated.

The greater the amounts by which the second set temperatures Ta to Tc are lower than the first set temperature Tw, the greater the power consumptions of the chillers 40A to 40C. In addition, when the differences between the second set temperatures Ta to Tc and the first set temperature Tw increase, the power consumptions Pa to Pc increase in a quadratic curve. Therefore, setting the first set temperature Tw to an excessively high temperature is not desired.

In view of this, the setting section 70 variably sets the first set temperature Tw to the average of the second set temperatures Ta to Tc obtained from the control sections A to C. For example, at time t3 of FIG. 3, the setting section 70 sets the first set temperature Tw to the average (=11° C.) of the second set temperatures Ta to Tc obtained from the control sections A to C. In this case as well, the chillers 40B and 40C satisfy the condition of performing free cooling. Therefore, the setting section 70 stops the compressor 41 and opens the on-off valve 58 in each of the chillers 40B and 40C, so that the chillers 40B and 40C perform free cooling.

The present embodiment having been described in detail above has the following advantages. Notably, only the advantages different from those of the first embodiment will be described.

Since it is possible to prevent the differences between the second set temperatures Ta to Tc and the first set temperature Tw from becoming extremely large, none of the power consumptions of the chillers become extremely large. Accordingly, the power consumption Pt of the entire cooling system 100 can be reduced.

Notably, the setting section 70 may set the first set temperature Tw to the average of the second set temperatures Ta to Tc obtained from the control sections A to C on the condition that the average of the second set temperatures Ta to Tc is higher than a predetermined temperature (for example, 0° C.). By virtue of such a configuration, the power consumption Po of the high-capacity refrigerator 10 can be prevented from becoming excessively large.

Also, the bypass flow passage 57 and the on-off valve 58 in each of the chillers 40A to 40C may be omitted. In such a case, the chillers 40A to 40C do not perform free cooling.

Third Embodiment

A third embodiment will now be described. In the following description, the difference between the third embodiment and the first embodiment will be mainly described. Notably, portions identical with those of the first embodiment are denoted by the same reference numerals, and their description will not be repeated.

In the present embodiment, as shown by broken lines at the right end of FIG. 1, the cooling system 100 includes several hundred or more chillers in addition to the chillers 40A to 40C. The branch flow passage 37 of each chiller 40 is connected to the common flow passage 35, and the branch flow passage 38 of each chiller is connected to the common flow passage 36.

The setting section 70 variably sets the first set temperature Tw to a stop temperature Tf which is a first set temperature Tw which allows target chillers (target second cooling apparatuses), which are chillers whose second set temperature is found in the largest number among the second set temperatures Ta, Tb, Tc, . . . obtained from the control sections A, B, C, . . . , to supply the third heat transfer medium of the largest-number second set temperature or lower in the state in which the compressor 41 is stopped and the on-off valve 58 is opened. Subsequently, the setting section 70 stops the compressor 41 and opens the on-off valve 58 in the target chillers.

As described above, the lower the first set temperature Tw, the larger the power consumption Po of the high-capacity refrigerator 10. Therefore, in the case where the largest-number second set temperature is lower than the predetermined temperature (for example, 0° C.), if the first set temperature Tw is set to the stop temperature Tf (for example, lower than −10° C.) and the target chillers are caused to perform free cooling, there arises a possibility that the power consumption Po of the high-capacity refrigerator 10 becomes excessively large and the power consumption Pt of the entire cooling system 100 cannot be reduced.

In order to avoid such an issue, on the condition that the second set temperature which is found in the largest number among the second set temperatures Ta, Tb, Tc, . . . obtained from the control sections A, B, C, . . . is higher than the predetermined temperature, the setting section 70 sets the first set temperature Tw to the stop temperature Tf, and stops the compressor 41 and opens the on-off valve 58 in each of the target chillers.

The present embodiment having been described in detail above has the following advantages. Notably, only the advantages different from those of the first embodiment will be described.

The target chillers, which are chillers employing a second set temperature which is found in the largest number among the second set temperatures Ta, Tb, Tc . . . , can supply, by means of free cooling, the third heat transfer medium cooled to the corresponding second set temperature or lower. Also, the power consumptions of the target chillers can be reduced greatly. Moreover, the number of target chillers which perform free cooling can be increased.

On the condition that the second set temperature which is found in the largest number among the obtained second set temperatures is higher than the predetermined temperature, the setting section 70 sets the first set temperature Tw to the stop temperature Tf, and stops the compressor 41 and opens the on-off valve 58 in each of the target chillers. Namely, in the case where the largest-number second set temperature is higher than the predetermined temperature, the target chillers perform free cooling, and, in the case where the largest-number second set temperature is lower than the predetermined temperature, the target chillers do not perform free cooling. Accordingly, the power consumption Pt of the entire cooling system 100 can be reduced.

Fourth Embodiment

A fourth embodiment will now be described. In the following description, the difference between the fourth embodiment and the first embodiment will be mainly described. Notably, portions identical with those of the first embodiment are denoted by the same reference numerals, and their description will not be repeated.

In the present embodiment, as shown by broken lines at the right end of FIG. 1, the cooling system 100 includes several hundred or more chillers in addition to the chillers 40A to 40C. The branch flow passage 37 of each chiller 40 is connected to the common flow passage 35, and the branch flow passage 38 of each chiller is connected to the common flow passage 36. Each chiller does not include the bypass flow passage 57 and the on-off valve 58. Namely, each chiller does not perform free cooling.

The power consumption Pt of the cooling system 100 changes depending on the combination of the first set temperature Tw and the plurality of second set temperatures. The relation among the first set temperature Tw, the plurality of second set temperatures, and the measured value of the power consumption Pt of the cooling system 100 can be obtained beforehand through, for example, an experiment.

In view of this, the setting section 70 variably sets the first set temperature Tw, on the basis of a previously obtained relation among the first set temperature Tw, the plurality of second set temperatures, and the measured value of the power consumption Pt of the cooling system 100, and the plurality of obtained second set temperatures, such that the power consumption Pt of the cooling system 100 becomes the minimum. By virtue of such a configuration, since the relation among the first set temperature Tw, the plurality of second set temperatures, and the measured value of the power consumption Pt of the cooling system 100 is obtained beforehand, it is possible to reduce the power consumption Pt of the entire cooling system 100 while reducing the processing load of the setting section 70.

Fifth Embodiment

A fifth embodiment will now be described. In the following description, the difference between the fifth embodiment and the fourth embodiment will be mainly described. Notably, portions identical with those of the first and fourth embodiments are denoted by the same reference numerals, and their description will not be repeated.

The setting section 70 may be configured to learn, through operation of the cooling system 100, a predetermined relation among the first set temperature Tw, the plurality of second set temperatures, and the measured value of the power consumption Pt of the cooling system 100. In such a case, the setting section 70 determines a direction in which the first set temperature Tw must be changed, for example, so as to decrease the measured value of the power consumption Pt, and changes the first set temperature Tw in that direction so as to decrease the measured value of the power consumption Pt.

The setting section 70 successively obtains the first set temperature Tw, the plurality of second set temperatures, and the measured value of the power consumption Pt of the cooling system 100; learns a predetermined relation among the first set temperature Tw, the plurality of second set temperatures, and the measured value of the power consumption Pt of the cooling system 100; and variably sets the first set temperature Tw on the basis of the learned predetermined relation and the plurality of obtained second set temperatures such that the power consumption Pt of the cooling system 100 becomes the minimum. By virtue of such a configuration, the setting section 70 can learn the predetermined relation through operation of the cooling system 100. Therefore, as the learning progresses, the accuracy of the predetermined relation increases, whereby the power consumption Pt of the entire cooling system 100 can be reduced further.

Sixth Embodiment

A sixth embodiment will now be described. In the following description, the difference between the sixth embodiment and the fourth embodiment will be mainly described. Notably, portions identical with those of the first and fourth embodiments are denoted by the same reference numerals, and their description will not be repeated.

In the present embodiment as well, as shown by broken lines at the right end of FIG. 1, the cooling system 100 includes several hundred or more chillers in addition to the chillers 40A to 40C. Each chiller does not include the bypass flow passage 57 and the on-off valve 58. Namely, each chiller does not perform free cooling. Also, the high-capacity refrigerator 10 does not include the bypass flow passage 27 and the on-off valve 28. Namely, the high-capacity refrigerator 10 does not perform free cooling.

The power consumption Po of the high-capacity refrigerator 10 changes in accordance with the first set temperature Tw. The relation between the first set temperature Tw and the measured value of the power consumption Po of the high-capacity refrigerator 10 can be obtained beforehand through, for example, an experiment. Since the power consumption Po of the high-capacity refrigerator 10 also changes depending on the atmospheric temperature and thus the temperature of the fifth heat transfer medium supplied from the cooling tower 30 to the high-capacity refrigerator 10. Therefore, for each atmospheric temperature, the relation between the first set temperature Tw and the measured value of the power consumption Po of the high-capacity refrigerator 10 is obtained beforehand through, for example, an experiment. Also, the power consumptions of the chillers change depending on the combination of the first set temperature Tw and the second set temperatures. The relation among the first set temperature Tw, the second set temperatures, and the measured values of the power consumptions of the chillers can be obtained beforehand through, for example, an experiment.

In view of this, the setting section 70 variably sets the first set temperature Tw, on the basis of a previously obtained first relation between the first set temperature Tw and the measured value of the power consumption Po of the high-capacity refrigerator 10, a previously obtained second relation among the first set temperature Tw, the second set temperatures, and the measured values of the power consumptions of the chillers, and the plurality of obtained second set temperatures, such that the sum of the power consumption Po of the high-capacity refrigerator 10 and the power consumptions of the plurality of chillers becomes the minimum. By virtue of such a configuration, the power consumption Po of the high-capacity refrigerator 10 and the power consumptions of the chillers can be calculated more accurately, whereby the power consumption Pt of the entire cooling system 100 can be reduced further.

Notably, in the case where a change in the power consumption Po of the high-capacity refrigerator 10 with the atmospheric temperature is small, the atmospheric temperature can be considered to be constant.

Seventh Embodiment

A seventh embodiment will now be described. In the following description, the difference between the seventh embodiment and the sixth embodiment will be mainly described. Notably, portions identical with those of the first and sixth embodiments are denoted by the same reference numerals, and their description will not be repeated.

The setting section 70 may be configured to learn the above-described first relation between the first set temperature Tw and the power consumption Po of the high-capacity refrigerator 10 through operation of the cooling system 100. Also, the setting section 70 may be configured to learn the above-described second relation among the first set temperature Tw, the second set temperatures, and the measured values of the power consumptions of the chillers through operation of the cooling system 100. In such a case, the setting section 70 determines a direction in which the first set temperature Tw must be changed, for example, so as to decrease the sum of the measured value of the power consumption Po and the measured values of the power consumptions of the plurality of chillers, and changes the first set temperature Tw in that direction so as to decrease the sum of the measured value of the power consumption Po and the measured values of the power consumptions of the plurality of chillers.

The setting section 70 successively obtains the first set temperature Tw and the measured value of the power consumption Po of the high-capacity refrigerator 10; learns the first relation between the first set temperature Tw and the measured value of the power consumption Po; successively obtains the first set temperature Tw, the second set temperatures, and the measured values of the power consumptions of the chillers; learns the second relation among the first set temperature Tw, the second set temperatures, and the measured values of the power consumptions of the chillers; and variably sets the first set temperature Tw on the basis of the learned first and second relations and the plurality of obtained second set temperatures such that the power consumption Pt of the cooling system 100 becomes the minimum. By virtue of such a configuration, the setting section 70 can learn the first and second relations through operation of the cooling system 100. Therefore, as the learning progresses, the accuracies of the first and second relations increase, whereby the power consumption Pt of the entire cooling system 100 can be reduced further.

Also, the above-described embodiments may be modified as follows. Portions identical with those of the above-described embodiments are denoted by the same reference numerals, and their description will not be repeated.

In the high-capacity refrigerator 10, the bypass flow passage 27 and the on-off valve 28 may be omitted. In such a case, the high-capacity refrigerator 10 does not perform free cooling.

The control targets may be electrodes of semiconductor manufacturing apparatuses, substrate holding portions, etc. of other manufacturing apparatuses and processing apparatuses, or heat exchangers (heat exchange sections) which exchange heat with heat transfer mediums supplied to the electrodes, the substrate holding portions, etc.

Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

What is claimed is:

1. A cooling system comprising:

a first cooling apparatus that is electrically driven and supplies a first heat transfer medium cooled to a first set temperature or lower;

a plurality of second cooling apparatuses, each of which:

comprises a heat exchanger that exchanges heat between the first heat transfer medium supplied from the first cooling apparatus and a second heat transfer medium, and is electrically driven and supplies a third heat transfer medium cooled to a second set temperature or lower, wherein the second set temperature changes over time; and a processor that obtains current second set temperatures of the second cooling apparatuses and variably sets the first set temperature based on the obtained current second set temperatures, wherein each of the second cooling apparatuses further comprises:

a compressor that is electrically driven and compresses the second heat transfer medium in a gas state;

a bypass flow passage through which the second heat transfer medium flows while bypassing the compressor; and an on-off valve that opens and closes the bypass flow passage, wherein the processor sets the first set temperature to a stop temperature that allows a target second cooling apparatus, having a highest second set temperature among the obtained current second set temperatures, to supply the third heat transfer medium cooled to the highest second set temperature or lower in a state where the compressor is stopped and the on-off valve is opened, and wherein the processor stops the compressor and opens the on-off valve in the target second cooling apparatus.

2. The cooling system according to claim 1, wherein upon detecting that the highest second set temperature is higher than a predetermined temperature, the processor sets the first set temperature to the stop temperature, stops the compressor, and opens the on-off valve in the target second cooling apparatus.

3. A cooling system comprising:

a first cooling apparatus that is electrically driven and supplies a first heat transfer medium cooled to a first set temperature or lower;

a plurality of second cooling apparatuses, each of which:

comprises a heat exchanger that exchanges heat between the first heat transfer medium supplied from the first cooling apparatus and a second heat transfer medium, and is electrically driven and supplies a third heat transfer medium cooled to a second set temperature or lower, wherein the second set temperature changes over time; and a processor that obtains current second set temperatures of the second cooling apparatuses and variably sets the first set temperature based on the obtained current second set temperatures, wherein each of the second cooling apparatuses further comprises:

a compressor that is electrically driven and compresses the second heat transfer medium in a gas state;

a bypass flow passage through which the second heat transfer medium flows while bypassing the compressor; and an on-off valve that opens and closes the bypass flow passage, wherein the processor sets the first set temperature to a stop temperature that allows target second cooling apparatuses, having a second set temperature found in a largest number among the obtained current second set temperatures, to supply the third heat transfer medium cooled to a largest-number second set temperature or lower in a state where the compressor is stopped and the on-off valve is opened, and wherein the processor stops the compressor and opens the on-off valve in each of the target second cooling apparatuses.

4. The cooling system according to claim 3, wherein upon detecting that the largest-number second set temperature is higher than a predetermined temperature, the processor sets the first set temperature to the stop temperature, stops the compressor, and opens the on-off valve in each of the target second cooling apparatuses.

5. A cooling system comprising:

a first cooling apparatus that is electrically driven and supplies a first heat transfer medium cooled to a first set temperature or lower;

a plurality of second cooling apparatuses, each of which:

comprises a heat exchanger that exchanges heat between the first heat transfer medium supplied from the first cooling apparatus and a second heat transfer medium, and is electrically driven and supplies a third heat transfer medium cooled to a second set temperature or lower, wherein the second set temperature changes over time; and a processor that:

obtains current second set temperatures of the second cooling apparatuses, and variably sets the first set temperature based on a previously obtained relation among a previous first set temperature, previous second set temperatures, and a measured value of power consumption of the cooling system, and based on the obtained current second set temperatures, such that the power consumption of the cooling system becomes minimum.

6. A cooling system comprising:

a first cooling apparatus that is electrically driven and supplies a first heat transfer medium cooled to a first set temperature or lower;

a plurality of second cooling apparatuses, each of which:

comprises a heat exchanger that exchanges heat between the first heat transfer medium supplied from the first cooling apparatus and a second heat transfer medium, and is electrically driven and supplies a third heat transfer medium cooled to a second set temperature or lower, wherein the second set temperature changes over time; and a processor that:

successively obtains the first set temperature, the second set temperatures, and a measured value of power consumption of the cooling system, learns a predetermined relation among the successively obtained first set temperature, the successively obtained second set temperatures, and the successively obtained measured value of the power consumption of the cooling system, obtains current second set temperatures of the second cooling apparatuses, variably sets the first set temperature based on the learned predetermined relation and the obtained current second set temperatures, such that the power consumption of the cooling system becomes minimum.

7. A cooling system comprising:

a first cooling apparatus that is electrically driven and supplies a first heat transfer medium cooled to a first set temperature or lower;

a plurality of second cooling apparatuses, each of which:

comprises a heat exchanger that exchanges heat between the first heat transfer medium supplied from the first cooling apparatus and a second heat transfer medium, and is electrically driven and supplies a third heat transfer medium cooled to a second set temperature or lower, wherein the second set temperature changes over time; and a processor that:

obtains current second set temperatures of the second cooling apparatuses, and variably sets the first set temperature, such that a sum of power consumption of the first cooling apparatus and power consumptions of the second cooling apparatuses becomes minimum, based on:

a previously obtained first relation between a previous first set temperature and a measured value of the power consumption of the first cooling apparatus, a previously obtained second relation among the previous first set temperature, previous second set temperatures, and measured values of the power consumptions of the second cooling apparatuses, and the obtained current second set temperatures.

8. A cooling system comprising:

a first cooling apparatus that is electrically driven and supplies a first heat transfer medium cooled to a first set temperature or lower;

a plurality of second cooling apparatuses, each of which:

comprises a heat exchanger that exchanges heat between the first heat transfer medium supplied from the first cooling apparatus and a second heat transfer medium, and is electrically driven and supplies a third heat transfer medium cooled to a second set temperature or lower, wherein the second set temperature changes over time; and a processor that:

successively obtains the first set temperature and a measured value of power consumption of the first cooling apparatus, learns a first relation between the successively obtained first set temperature and the successively obtained measured value of the power consumption of the first cooling apparatus, successively obtains the first set temperature, the second set temperatures, and measured values of power consumptions of the second cooling apparatuses, learns a second relation among the successively obtained first set temperature, the successively obtained second set temperatures, and the successively obtained measured values of the power consumptions of the second cooling apparatuses, obtains current second set temperatures of the second cooling apparatuses, and variably sets the first set temperature based on the learned first relations, the learned second relations, and the obtained current second set temperatures, such that the power consumption of the cooling system becomes minimum.

9. A cooling system comprising:

a first cooling apparatus that is electrically driven and supplies a first heat transfer medium cooled to a first set temperature or lower;

a plurality of second cooling apparatuses, each of which:

comprises a heat exchanger that exchanges heat between the first heat transfer medium supplied from the first cooling apparatus and a second heat transfer medium, and is electrically driven and supplies a third heat transfer medium cooled to a second set temperature or lower, wherein the second set temperature changes over time; and a processor that obtains current second set temperatures of the second cooling apparatuses and variably sets the first set temperature based on the obtained current second set temperatures, wherein the first cooling apparatus comprises:

a first compressor that is electrically driven and compresses a fourth heat transfer medium in a gas state;

a first heat exchanger that exchanges heat between the fourth heat transfer medium and a fifth heat transfer medium cooled by atmospheric air;

a first bypass flow passage through which the fourth heat transfer medium flows while bypassing the first compressor; and a first on-off valve that opens and closes the first bypass flow passage, and wherein when the first cooling apparatus can supply the first heat transfer medium cooled to the first set temperature or lower in a state where the first compressor is stopped and the first on-off valve is opened, the processor stops the first compressor and opens the first on-off valve.

* * * * *